United States Patent [19]

Bitzer

[11] 4,027,506

[45] June 7, 1977

[54] DRAW-OFF AND TAKE-UP ARRANGEMENT FOR CIRCULAR KNITTING MACHINES

[75] Inventor: Hans Eugen Bitzer, Schorndorf, Germany

[73] Assignee: Firma C. Terrot Sohne, Stuttgart, Germany

[22] Filed: Oct. 14, 1975

[21] Appl. No.: 621,755

[52] U.S. Cl. ..... 66/149 R; 242/55; 139/304

[51] Int. Cl.² ..... D04B 15/88

[58] Field of Search ..... 66/149 R, 152, 151, 66/153; 26/70; 242/55; 139/304

[56] References Cited

UNITED STATES PATENTS

| | | | |
|---|---|---|---|
| 851,938 | 4/1907 | Hull | 26/70 |
| 2,872,188 | 2/1959 | Harkins et al. | 242/55 X |
| 3,301,497 | 1/1967 | Okazaki | 242/55 |

FOREIGN PATENTS OR APPLICATIONS

| | | | |
|---|---|---|---|
| 85,289 | 12/1955 | Denmark | 242/55 |
| 39,323 | 10/1886 | Germany | 66/151 |
| 614,350 | 12/1960 | Italy | 66/152 |

*Primary Examiner*—Mervin Stein
*Assistant Examiner*—A. M. Falik

[57] ABSTRACT

A knitted fabric draw-off and take-up arrangement for circular knitting machines, including an idle take-up roller and at least one driven draw-off roller. The tubular knitted fabric is passed from the draw-off roller to the take-up roller and is then returned to the draw-off roller after passing around the take-up roller and finally is returned and secured to the take-up roller thereby the tubular knitted fabric is wound onto the take-up roller and also drives this idle take-up roller.

3 Claims, 3 Drawing Figures

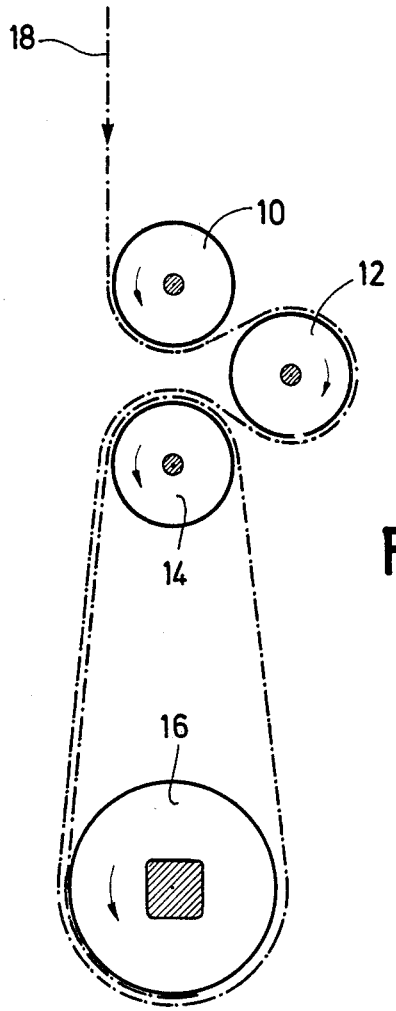
Fig. 1
Fig. 3
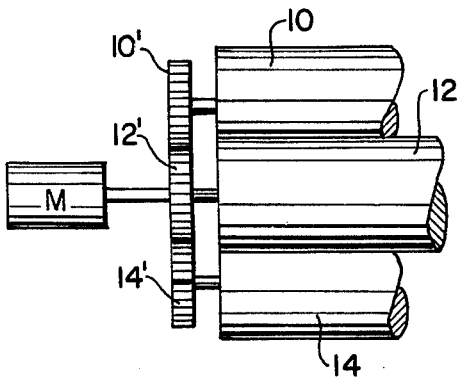

DRAW-OFF AND TAKE-UP ARRANGEMENT FOR CIRCULAR KNITTING MACHINES

BACKGROUND OF THE INVENTION

The invention relates to a draw-off, take-up and winding arrangement for circular knitting machines wherein the tube of knitted material is wound around a take-up roller or beam thereby driving the latter and includes furthermore a draw-off roller arrangement.

With known arrangements of this type, the tube of knitted fabric is taken up by a set of driven take-up rollers. It has, however, been found that in practise such an arrangement frequently causes malfunctioning because the tube of knitted material cannot always be sufficiently, uniformly wound on the take-up rollers. Furthermore, when sensitive knitted material is to be wound, for example a material having an open or irregular pattern, the winding of the knitted fabric solely by means of driven take-up rollers results in a twisting between the inner layers of knitted fabric, which must absorb the winding or take-up forces, and the outer layers of such knitted fabric.

In the conventional arrangements of the afore-described type, the tube of knitted fabric is drawn off from the circular knitting machine by a pair of draw-off rollers. It is also already known to use three draw-off rollers in such an arrangement, in which two of these rollers are biased against a middle draw-off roller, and the latter is driven by means of a motor. A gear wheel is mounted on the spindle of each draw-off roller and these gear wheels resiliently mesh with each other so that tubular knitted fabrics of different thickness can be drawn off by such an arrangement.

Furthermore, in order to obtain a uniform take-up which also protects the tubular knitted fabric there has already been proposed to utilize an endless band which is guided over a plurality of draw-off rollers and to place the tubular knitted material between this band and one of the draw-off rollers, thereby obtaining as uniform as possible a distribution of take-up forces for both adjacent layers of the tubular knitted material (see, for example, German published patent application No. 1,635,799).

It is a general object of this invention, to provide an arrangement for drawing off, taking up and winding a hose of knitted material of the aforementioned type, wherein the tube of knitted material is more delicately and more uniformly wound up as it is in the arrangements of the prior art as described hereinabove.

According to the invention this object is attained by making the winding roller a freely rotatable idle roller and having the tube of knitted material guided from the draw-off roller to the take-up roller, and after being wound around the take-up roller it is guided back to the draw-off roller and again wound around the latter and then is secured to the periphery of the take-up roller, so that the tube of knitted material wound around the take-up roller serves to drive the latter. Thus, the portion of the tube of knitted material which is wound around the take-up roller and is then guided onto the draw-off roller before being wound on the take-up roller, presses just that portion of the tube of knitted fabric which is about to be wound onto the take-up roller against the latter or layers of knitted fabric wound on the latter, whereby frictional engagement is increased and the winding is soft and more uniform.

This solution is not apparent from the known take-up arrangement of published German application No. 1,635,799 because the afore-described prior art arrangement constitutes a draw-off arrangement and not a take-up arrangement and, furthermore, the arrangement of this invention does not utilize a separate, endless band for winding the fabric onto the take-up rollers, and, finally, a transposition of known features of a draw-off arrangement to a take-up arrangement would lead to a construction requiring additional elements for pressing the endless band against the take-up rollers, respectively, the knitted fabric coil and, furthermore, would require a driving of the take-up arrangement which is precisely what has been avoided by the arrangement of this invention. By means of the arrangement of this invention all synchronization problems between the take-up roller and driven draw-off rollers are avoided. The arrangement of this invention uses advantageously a construction wherein at least a pair of draw-off rollers are biased toward each other and the tube of knitted fabric passes therebetween is mounted between. An idle roller is mounted between the pair of draw-off rollers. The tube of knitted material is guided about these three rollers prior to being wound on the take-up roller. It is particularly advantageous to utilize an embodiment having three draw-off rollers which are resiliently mounted and biased against each other; one of these three draw-off rollers is an idle guide roller. The latter arrangement of the invention is particularly advantageous in ensuring that the knitted fabric is not damaged during the take-up operation.

BRIEF DESCRIPTION OF THE DRAWING

The above-mentioned as well as numerous other features and advantages of the present invention will become further apparent from the following detailed description thereof, which is to be read with reference to the accompanying drawing, in which:

FIG. 1 is a schematic illustration of a first embodiment of the invention;

FIG. 3 is a side view of the arrangement of FIG. 1, including additional facilities for driving the draw-off rollers of such first embodiment.

DETAILED DESCRIPTION

Figure 2:
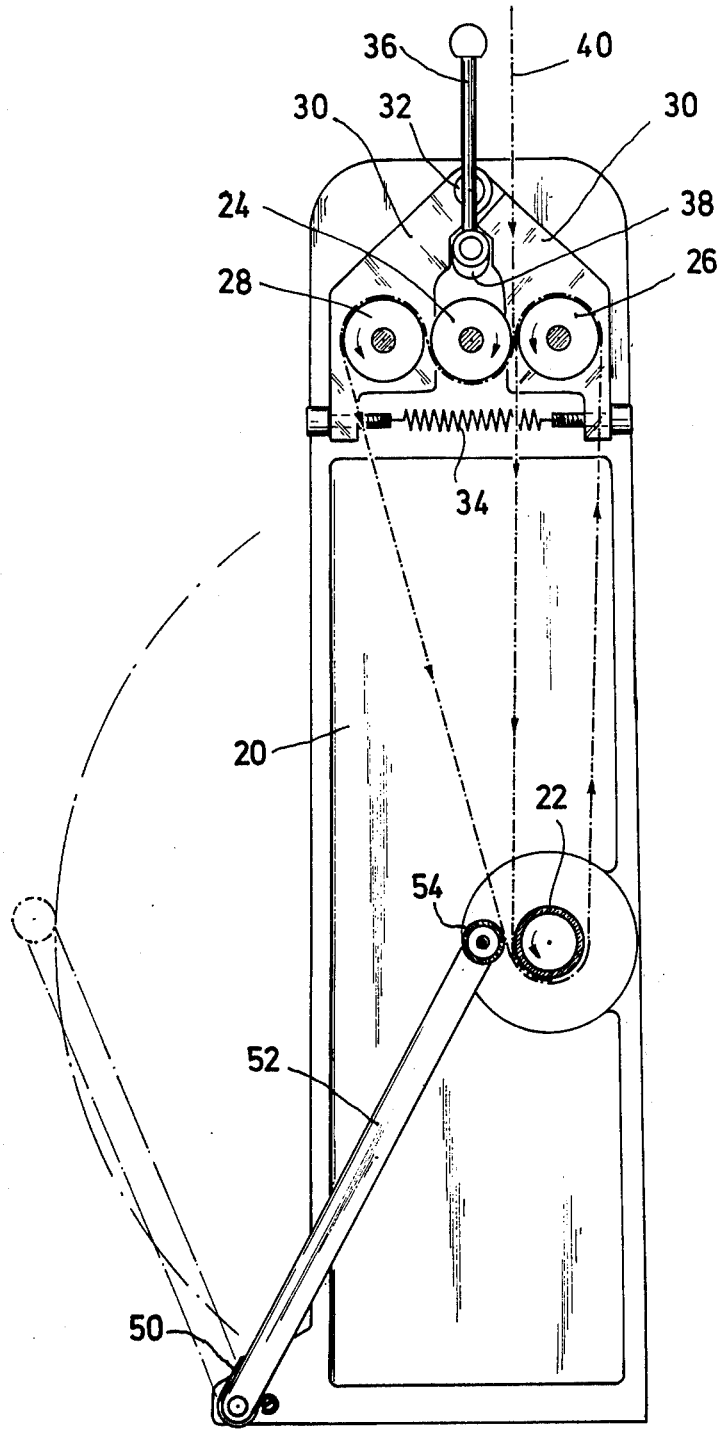
FIG. 2 is a further detailed cross-section illustration of a second embodiment of the invention.

FIG. 1 illustrates three draw-off rollers 10, 12 and 14, which are mounted on a supporting structure in a manner to permit the adjustment of the distances between the supporting shafts of the rollers (mechanism not illustrated), which makes it possible to have the draw-off rollers 10 and 14 resiliently biased against the idle take-up roller 12. This mechanism is conventional and has not been illustrated in FIG. 1 for sake of clarity and simplicity. The draw-off rollers can, in a known manner, have on their outer periphery a friction-increasing layer; furthermore, it is advantageous to connect the individual rollers with gear wheels 10', 12' and 14' (FIG. 3) that mesh yieldingly in a radial direction relative to the meshing gear teeth, so that only one of the draw-off rollers, for example the draw-off roller 12, has to be driven illustrated by a motor M. The reference numeral 16 (FIG.1) indicates a take-up roller which is freely rotatable in the support structure.

The tube of knitted fabric 18 which is being withdrawn from a non-illustrated circular knitting machine is first guided around and between the draw-off rollers 10–14 and is then led around the take-up roller 16, whereafter the hose of knitted material is once again placed around the draw-off roller 14 and finally is secured in a non-illustrated conventional manner with its leading end on the periphery of the take-up roller 16. Thereafter the drive mechanism (not illustrated) for the draw-off rollers 10–14 is actuated, whereafter the different rollers begin to rotate in the directions indicated by the arrows. The take-up roller 16 is thus driven by means of the tubular knitted fabric itself and that portion of the tube which is being taken up is pressed uniformly against the take-up roller 16, respectively the already wound tubular knitted fabric, whereby a particularly delicate and uniform winding process is obtained.

FIG. 2 illustrated a sectional view normal to the roller axes of a second embodiment so that only one cheek of a support structure 20 is illustrated on which the take-up roller 22 is freely rotatably mounted. A draw-off roller 24 is furthermore rotatably mounted between the cheeks of the support structure, whereas two further draw-off rollers 26 and 28 are rotatably mounted on swingable arms 30, which are pivotally supported on a pivot pin 32 fixed to the support structure 20. Springs 34 engage the arms 30 and press the draw-off roller 26 and 28 against the driven (driving mechanism not illustrated) draw-off roller 24. As has already been described above with respect to the first embodiment of the invention, the draw-off rollers 24,28 are coupled to each other by means of meshing gear wheels (not illustrated). A lever 36 pivotally mounted on the support structure 20 serves to separate by means of an oval cam surface 38, which coacts with the arms 30, the draw-off rollers 26 and 28 from the draw-off roller 24.

The tube of knitted fabric is designated by the reference numeral 40 and this tube is withdrawn from the circular knitting machine. This tube 40 is first placed between the draw-off rollers 24 and 26 and is then guided about the draw-off rollers 24 and 28, whereby the tube is wound around the idle take-up roller 22 and the the tube is led back to the draw-off roller 26. Thereafter, the tube is wound again around the idle take-up roller 22 and whereafter the forward end of the tube is secured with its leading end to the periphery of the take-up roller 22 by non-illustrated means. After the drive for the draw-off roller 24 has been actuated, the tube of knitted fabric is withdrawn from the circular knitting machine and the take-up roller 22 is rotated by means of the tube 40 and the latter is than wound onto the take-up roller 22.

It is also advantageous to provide the arrangement with two levers 52 pivoted onto the structure 20. The levers 52 are biased by means of springs 50 so that a presser roller 54 supported on the free ends thereof is pressed against the tube 40. The presser roller 54 is therefore springingly biased against the coil of tubular knitted fabric which ensures that the wound fabric conforms as precisely as possible to the cylindrical contour of the take-up roller 22.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A knitted fabric draw-off and take-up arrangement for circular knitting machines, comprising in combination, a support structure;

an idle take-up roller rotatably mounted in said support structure;

at least one draw-off roller rotatably mounted in said support structure, the axes of said take-up roller and draw-off roller being parallel;

driving means operatively connected to said draw-off roller for drivingly rotating the latter;

said arrangement being adapted to withdraw tubular knitted fabric from a circular knitting machine and to guide it as least partially around the draw-off roller and then at least partially around the take-up roller and then again at least partially around the draw-off roller and then is wound on the take-up roller, so that the tubular knitted fabric drives the idle take-up roller.

2. The knitted fabric draw-off and take-up arrangement for circular knitting machines as set forth in claim 1, wherein at least two draw-off rollers and a guide roller are rotatably mounted in said support structure, said draw-off rollers are biased against each other and the draw-off and guide rollers have parallel axes; whereby said tubular knitted fabric is guided between said two draw-off rollers and at least partially around said guide roller and then at least partially around said take-up roller and finally at least partially around one of the draw-off rollers or the guide roller and then is wound on the take-up roller.

3. The knitted fabric draw-off and take-up arrangement for circular knitting machines as set forth in claim 2, wherein three draw-off rollers are rotatably mounted in said support structure parallelly relative to each other, the two outer draw-off rollers are resiliently biased against the middle draw-off roller, the latter operating as a guide roller.

* * * * *